US009310720B2

(12) United States Patent
Suzuki

(10) Patent No.: US 9,310,720 B2
(45) Date of Patent: Apr. 12, 2016

(54) IMAGE FORMING APPARATUS

(71) Applicant: CANON KABUSHIKI KAISHA, Tokyo (JP)
(72) Inventor: Shinya Suzuki, Abiko (JP)
(73) Assignee: CANON KABUSHIKI KAISHA, Tokyo (JP)

( * ) Notice: Subject to any disclaimer, the term of this patent is extended or adjusted under 35 U.S.C. 154(b) by 0 days.
(21) Appl. No.: 14/736,324
(22) Filed: Jun. 11, 2015
(65) Prior Publication Data
US 2015/0362864 A1 Dec. 17, 2015
(30) Foreign Application Priority Data
Jun. 17, 2014 (JP) ..... 2014-124430
(51) Int. Cl.
*G03G 15/09* (2006.01)
(52) U.S. Cl.
CPC ..... *G03G 15/0921* (2013.01)
(58) Field of Classification Search
USPC ..... 399/276
See application file for complete search history.

(56) References Cited

U.S. PATENT DOCUMENTS

| | | | | |
|---|---|---|---|---|
| 5,379,094 | A * | 1/1995 | Wing | G03G 15/095 399/264 |
| 8,548,364 | B2 * | 10/2013 | Oba | G03G 15/0818 399/270 |
| 2006/0204285 | A1 * | 9/2006 | Zemba | G03G 15/0921 399/276 |
| 2011/0129262 | A1 * | 6/2011 | Nakamoto | G03G 15/0818 399/286 |

FOREIGN PATENT DOCUMENTS

| | | | |
|---|---|---|---|
| JP | H09-050187 | A | 2/1997 |
| JP | 2000-321864 | A | 11/2000 |
| JP | 3272208 | B2 | 4/2002 |
| JP | 2003-140460 | A | 5/2003 |
| JP | 2011-102850 | A | 5/2011 |
| JP | 2013-238811 | A | 11/2013 |

* cited by examiner

*Primary Examiner* — Rochelle-Ann J Blackman
*Assistant Examiner* — Linda B Smith
(74) *Attorney, Agent, or Firm* — Fitzpatrick, Cella, Harper & Scinto

(57) ABSTRACT

An image forming apparatus, includes a developing device developing an electrostatic latent image formed on an image bearing member. The developing device includes a developer bearing member having a developing sleeve and a magnet, with the developing sleeve being rotatable in the direction opposite to the rotational direction of the image bearing member, the magnet being fixed in the developing sleeve, and grooves extending in the axial direction being provided on a surface of the developing sleeve. An angle α between a wall surface of the grooves at an upstream side in the rotational direction of the developing sleeve and the direction perpendicular to the surface of the developing sleeve is greater than an angle γ of a magnetic brush of the developer formed at a closest portion between the image bearing member and the developer bearing member on an outermost surface of the developing sleeve.

6 Claims, 11 Drawing Sheets

IN CASE OF WHITE BACKGROUND

IN CASE OF SOLID PORTION

IMAGE FORMING APPARATUS

BACKGROUND OF THE INVENTION

1. Field of the Invention

The present invention relates to an image forming apparatus such as a copying machine, a printer and a facsimile.

2. Description of the Related Art

A conventional image forming apparatus has been proposed in Japanese Patent Laid-Open No. H09-50187. This image forming apparatus employs the counter developing system in which the rotational direction of the photosensitive drum and the rotational direction of the developing roller opposed to the photosensitive drum are opposite in the developing portion.

Also, a conventional developing roller has been proposed in Japanese Patent Laid-Open No. 2000-321864. In this developing roller, a plurality of linear grooves extending in the axial direction perpendicular to the driving direction on the sleeve surface are formed at a predetermined interval in the circumferential direction of the developing sleeve so that the developer borne on the developing sleeve of the developing roller can be sufficiently conveyed.

However, in the counter development method of Japanese Patent Laid-Open No. H09-50187, the photosensitive drum rotates in the direction opposite to the conveying direction of the developer borne on the developing roller at the developing portion. Thus, the magnetic brush which is in contact with the photosensitive drum receives a force in the direction opposite to the developer conveying direction. In particular, the closest portion of the photosensitive drum and the developing roller is made narrow in order to obtain high developing performance. Thus, the magnet brush is likely to receive an opposing force. As a result, the developer borne on the developing roller becomes difficult to pass through the closest portion and the developer is likely to remain in the vicinity of the closest portion.

When stagnation of the developer occurs at the developing portion, toner which has been used for developing an electrostatic latent image at an upstream portion of the rotational direction of the photosensitive drum with respect to the developing portion on the photosensitive drum is scraped by the developer stagnating at a downstream portion of the rotational direction of the photosensitive drum. As a result, image defects such as image blurring occur.

When the stagnation of the developer has deteriorated, the developer including magnetic carrier coated as a thin layer and borne on the developing sleeve by the magnet in the developing sleeve moves to a position where retention by a magnetic force does not work due to the stagnation. The developer including the magnetic carrier overflows from the developing device thereby a defect occurs such as discharging in a state where the magnetic carrier is attached to the sheet. Furthermore, the magnetic carrier which has overflowed from the developing device is conveyed to the transfer means, the fixing means and the like as well as the toner image. As a result, a large part of the main body of the image forming apparatus is damaged.

Therefore, in the counter developing system, a high conveying performance of the developer is required at the closest portion between the photosensitive drum and the developing roller. However, even with the developing sleeve to form linear grooves of Japanese Patent Laid-Open No. 2000-321864, conveying performance deteriorates and the stagnation is likely to occur.

SUMMARY OF THE INVENTION

The present invention provides an image forming apparatus of the counter developing system using a two-component developer, wherein the stagnation at the vicinity of the opposing portion between the photosensitive drum and the developing sleeve is suppressed, while obtaining a high developing performance.

A typical configuration of an image forming apparatus according to the present invention is an image forming apparatus, comprising:

an image bearing member; and a developing device which develops an electrostatic latent image formed on the image bearing member into a toner image using toner, the developing device accommodating two-component developer in which toner and carrier are mixed, the developing device including a developer bearing member which has a developing sleeve and a magnet, the developing sleeve being rotatable in the direction opposite to the rotational direction of the image bearing member at a portion opposing to the image bearing member, the magnet being fixed and held in the developing sleeve, a plurality of grooves extending in the axial direction being provided on a surface of the developing sleeve at a predetermined interval in the circumferential direction, wherein the angle $\alpha$ between a wall surface of each of the grooves at an upstream side in the rotational direction of the developing sleeve and the direction perpendicular to the surface of the developing sleeve is greater than the angle $\gamma$ of a magnetic brush of the two-component developer formed at a closest portion between the image bearing member and the developer bearing member on an outermost surface of the developing sleeve.

Further features of the present invention will become apparent from the following description of exemplary embodiments with reference to the attached drawings.

DESCRIPTION OF THE EMBODIMENTS

First Embodiment

Figure 1:
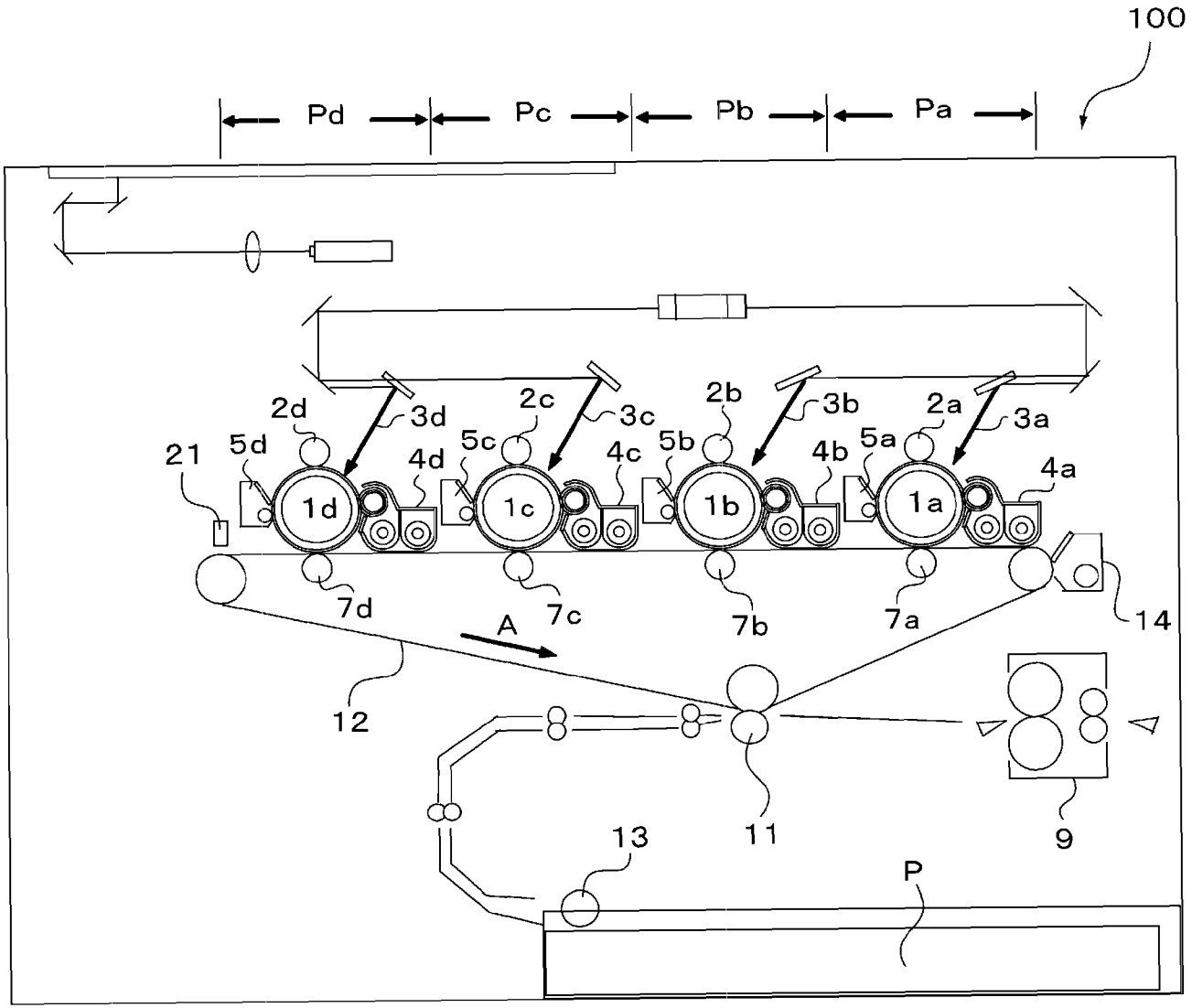
FIG. 1 is a configuration diagram of an image forming apparatus according to the first embodiment of the present invention.

The first embodiment of an image forming apparatus according to the present invention will be described with reference to figures. FIG. 1 is a diagram of an image forming apparatus 100 according to this embodiment.

As shown in FIG. 1, the image forming apparatus 100 includes four image forming stations Pa, Pb, Pc, and Pd. In the image forming stations Pa to Pd, the photosensitive drums (image bearing members) 1 (1*a* to 1*d*) charged by the charging devices 2 (2*a* to 2*d*) are exposed by the exposure devices 3 (3*a* to 3*d*) in accordance with image information respectively and electrostatic latent images are formed. The formed electrostatic latent images are developed into toner images of the yellow, magenta, cyan and black by the developing devices 4 (4*a* to 4*d*) respectively, and are primarily transferred onto the intermediate transfer belt 12 in a superimposed manner by the primary transfer rollers 7 (7*a* to 7*d*). The transfer residual toner remaining on the photosensitive drums 1*a* to 1*d* after the primary transfer is cleaned by the cleaning devices 5 (5*a* to 5*d*).

On the other hand, the sheet P stored in the sheet cassette 13 is conveyed to the nip portion between the secondary transfer roller 11 and the intermediate transfer belt 12, the toner image borne on the intermediate transfer belt 12 is secondarily transferred on the sheet P. The sheet P on which the toner image has been transferred is heated and pressured by the fixing device 9 thereby the toner image on the sheet P is fixed. Thereafter, the sheet P is discharged to the outside of the image forming apparatus. The transfer residual toner remaining on the intermediate transfer belt 12 after the secondary transfer is cleaned by the intermediate transfer belt cleaning blade 14.

Figure 2:
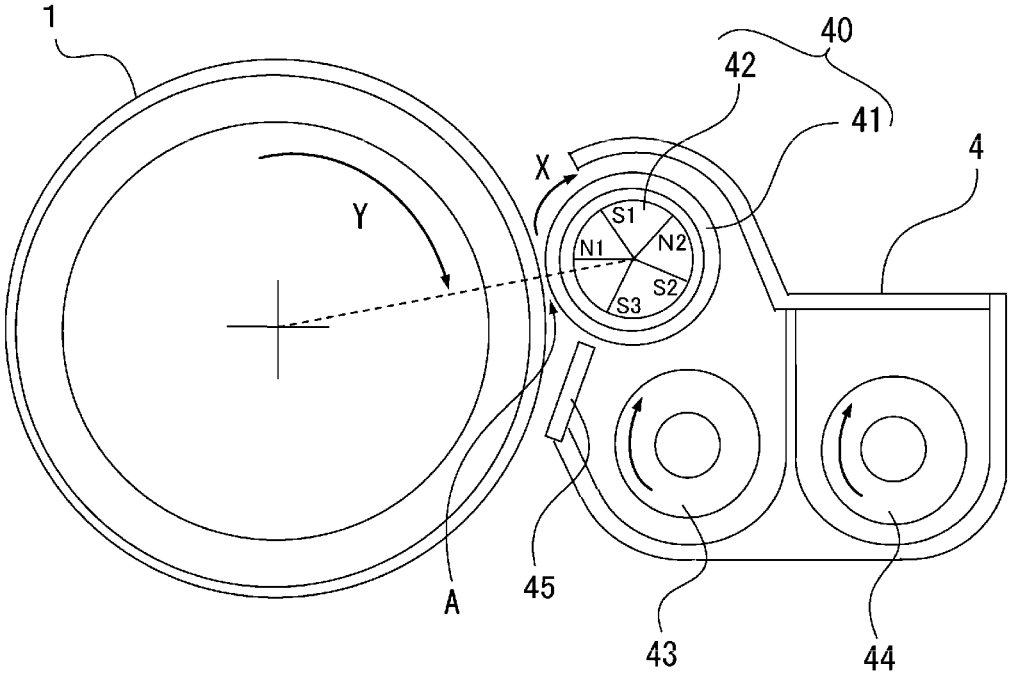
FIG. 2 is a configuration diagram of a developing device according to the first embodiment of the present invention.

(Developing device 4) FIG. 2 is a configuration diagram of the developing device 4 according to the present embodiment. As shown in FIG. 2, each of the developing units 4 (4*a* to 4*d*) includes the developing roller (developer bearing member) 40, the conveying screws 43 and 44, and the regulating blade 45. The developing roller 40 includes the developing sleeve 41 of a rotatable non-magnetic type and the magnet 42 fixed inside the developing sleeve 41. A part of the outer circumferential surface of developing sleeve 41 is exposed to the outside of the developing device 4, and the developing sleeve 41 is opposed to the photosensitive drum 1 while maintaining a closest distance (S-D gap) between the developing sleeve 41 and the photosensitive drum 1. The opposing portion between the photosensitive drum 1 and the developing sleeve 41 works as a developing portion. In the magnet 42, the drawing-up pole S3, the developing pole N1, the conveying pole S1, the conveying pole N2 and the stripping pole S2 are arranged in this order.

The two-component developer which has non-magnetic toner and magnetic carrier contained in the developing devices 4 (4*a* to 4*d*) is stirred by the conveying screws 43 and 44 and is conveyed to the developing roller 40. The two-component developer conveyed to the developing roller 40 is borne on the developing sleeve 41 by the drawing-up pole S3 of the magnet 42. Then, the developer is made into a thin layer on the developing sleeve by the regulating blade 45 opposed to the drawing-up pole S3

Then the developer is conveyed to the developing pole N1 by the developing sleeve 41 being driven to rotate in the X direction and an electrostatic latent image formed on the photosensitive drum 1 is developed with toner. Furthermore, the developer is conveyed to the conveying pole S1, the conveying pole N2, and the stripping pole S2. The developer is stripped from the developing sleeve by the repulsive magnetic field formed by the stripping pole S2 and the drawing-up pole S3 and is returned to the conveying screw 43.

The developing pole N1 is disposed at the position of 6° in the downstream of the rotational direction X from the closest portion A of the photosensitive drum 1 and the developing sleeve 41. When the developer is borne and conveyed on the developing sleeve, the gap at the opposing portion between the photosensitive drum 1 and the developing sleeve 41 is the narrowest and it is difficult to convey the developer there.

Figure 3:
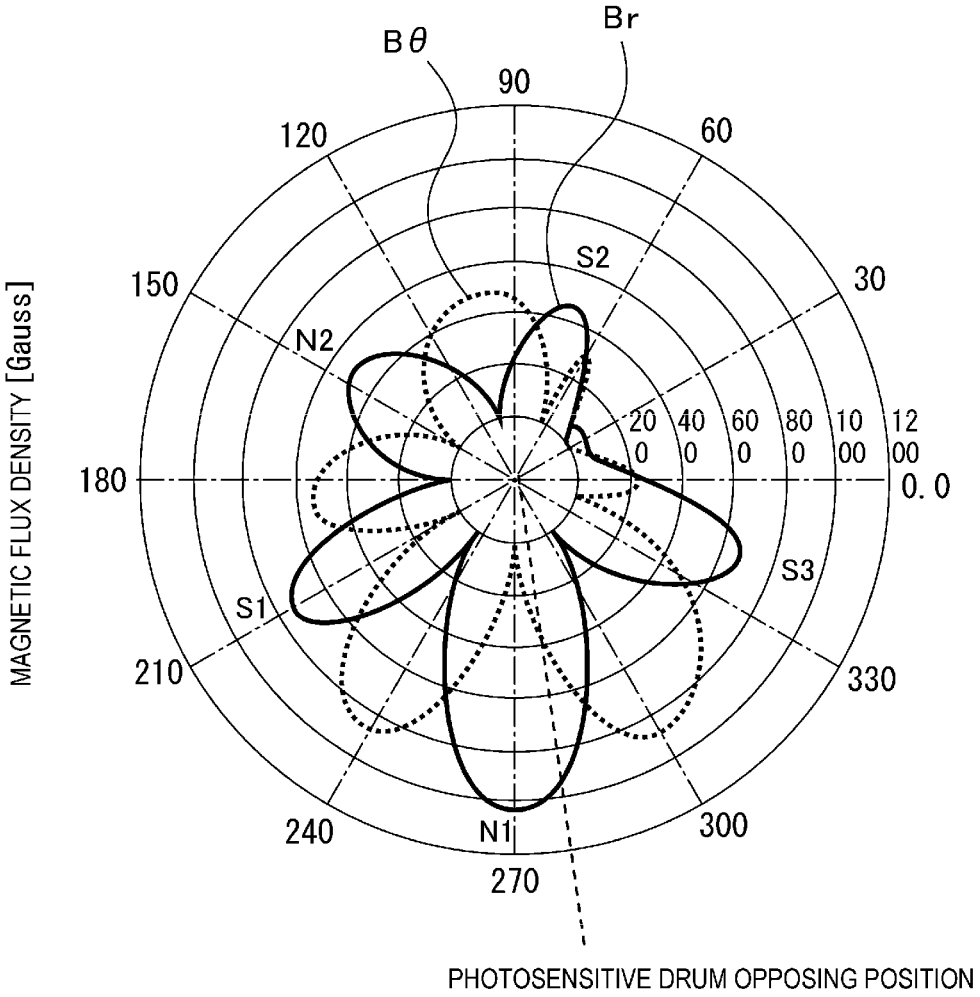
FIG. 3 is a view showing a magnet pattern of a magnet according to the first embodiment of the present invention.

FIG. 3 is a view showing a magnet pattern of the magnet 42 of this embodiment. In FIG. 3, the solid line represents the magnetic flux density Br in the normal direction of the developing roller 40. The broken line indicates the magnetic flux density Bθ of the tangential direction of the developing roller 40.

Figure 4:
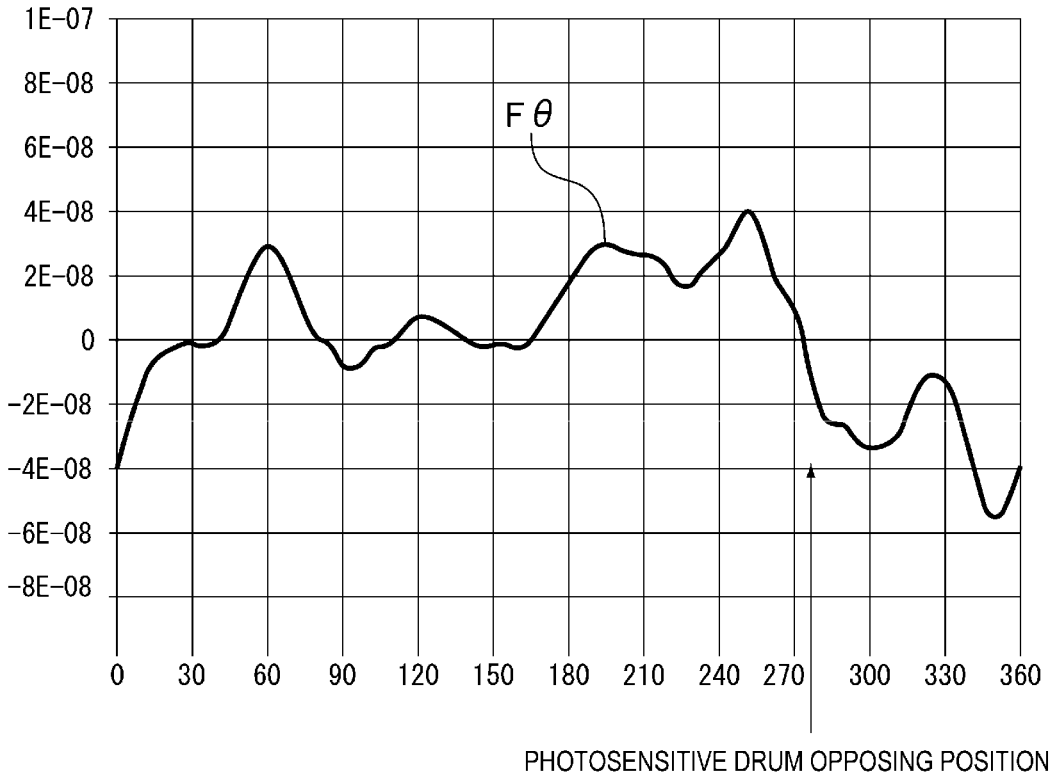
FIG. 4 is a diagram showing the force $F\theta$ in the tangential direction of a developing roller, caused by the magnet according to the first embodiment of the present invention.

FIG. 4 is a diagram showing the forces Fθ in the tangential direction of the surface of the developing sleeve 41 generated by the magnet 42 having the magnet pattern of FIG. 3. FIG. 4 uses the horizontal axis as an angle rather than circumferential display in order that the direction of the force Fθ working in the tangential direction can be displayed.

In FIG. 4, the force of the positive side indicates a force working in the opposite direction to the rotational direction X of the developing sleeve 41 and the force of the negative side indicates the force working in the same direction of the rotational direction X. At the developing pole N1 (the position of 270° in FIGS. 3 and 4), the weak force Fθ works in the plus side of the tangential direction of the developing sleeve 41 (the direction opposite to the rotational direction X). For this reason, when the developing pole N1 is placed at the closest portion A, the conveying force in the direction of conveying developer by a magnetic force of the developing sleeve 41 cannot be obtained. However, at an angular position which is out of the developing pole N1, the force Fθ works toward the developing pole N1.

Thus, the peak position of the magnetic flux density Br of the developing pole N1 is shifted to a position in the downstream of the rotational direction of the developing sleeve 41 from the closest portion A of the photosensitive drum 1 and the developing sleeve 41. As a result, at the closest portion A, the conveying force of developer by the magnetic force is generated in the direction of minus side (the same direction of the rotational direction X) and the developer can be easily conveyed.

Figure 5A:
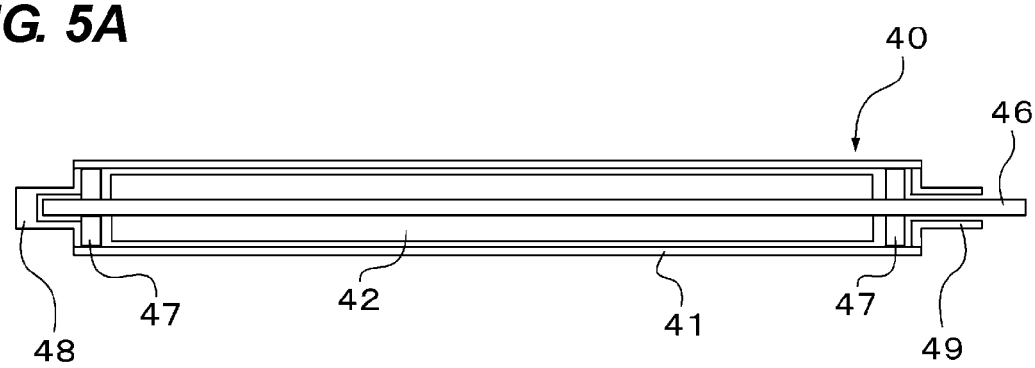
FIG. 5A is a cross-sectional view along the axial direction of the developing roller according to the first embodiment of the present invention.
Figure 5B:
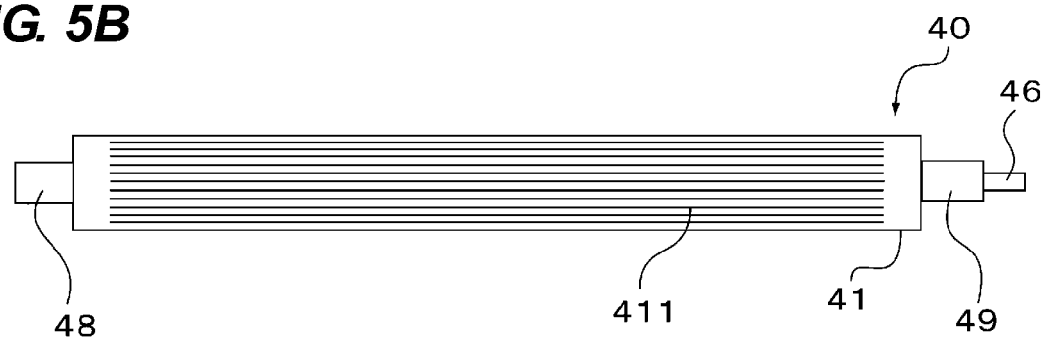
FIG. 5B is an external view of the developing roller according to the first embodiment of the present invention.
Figure 5C:
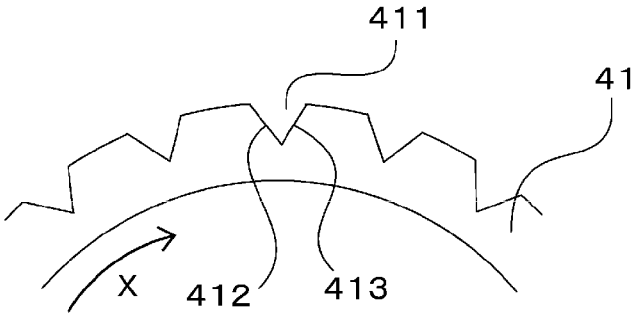
FIG. 5C is a diagram showing a partial cross-sectional view of the developing sleeve according to the first embodiment of the present invention.

FIG. 5A is a sectional view in the axial direction of the developing roller 40. FIG. 5B is an external view of the developing roller 40. FIG. 5C is a diagram showing a partial cross-section of the developing sleeve 41. As shown in FIG. 5A, the magnet 42 is fixed around the mandrel 46 of the developing roller 40 and the developing sleeve 41 of non-magnetic material is provided on the outer periphery of the magnet 42.

The developing sleeve 41 is connected to the mandrel 46 via the bearing portions 47 which are provided outside of the magnet 42. A predetermined interval is provided between the developing sleeve 41 and the magnet 42. At the outside of the bearings 47 in the axial direction of the developing sleeve 41, the drive side flange 48, the fixed side flange 49 are connected to the developing sleeve 41.

The developing sleeve 41 is formed of aluminum or stainless steel. The drive side flange 48 and the fixed side flange 49 are rotated with the developing sleeve 41 while being held to the developing container. Thus, the drive side flange 48 and the fixed side flange 49 are made of wear proof aluminum or stainless steel or the like.

As shown in FIGS. 5B and 5C, a plurality of linear grooves 411 which extend in the axial direction of the developing roller 40 are provided on the developing surface at a predetermined interval in the circumferential direction. Each of the linear grooves 411 is a V-shaped groove formed by the upstream wall 412 located in the upstream of the rotational direction X of the developing sleeve 41 and the downstream wall 413 located in the downstream. The developing sleeve 41 of which surface is roughened by the linear grooves 411 as described above is superior in wear resistance and conveying performance in case of bearing developer on the surface to the developing sleeve roughened by blasting.

In this embodiment, the outer diameter of the developing sleeve 41 is 20 mm and 50 linear grooves 411 are provided on the circumferential surface at substantially the same intervals. The thickness of the developing sleeve 41 is 800 μm. The depth of linear grooves 411 is 100 μm.

Figure 6:
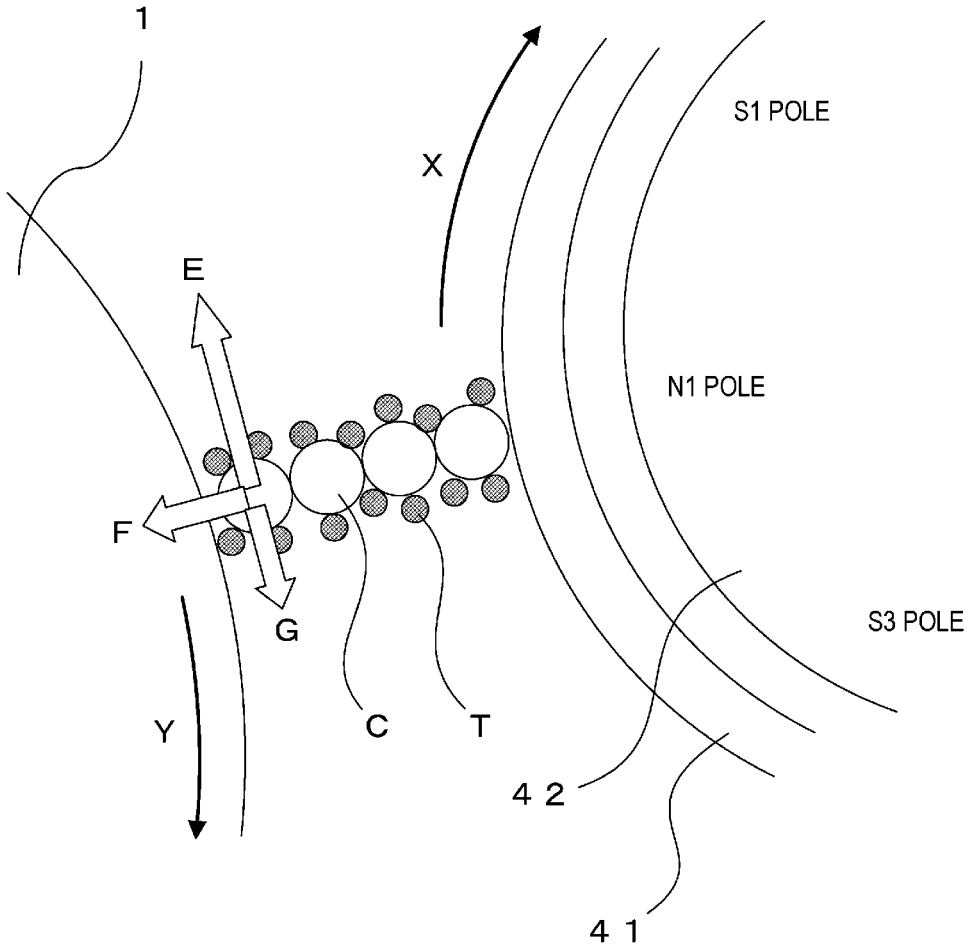
FIG. 6 is a schematic view of the vicinity of the developing portion of the image forming apparatus according to the first embodiment of the present invention.

(Stagnation of developer in counter development system) FIG. 6 is a schematic view of the vicinity of the developing portion of the image forming apparatus 100 according to this embodiment. As shown in FIG. 6, the two-component developer in which the non-magnetic toner T and magnetic carrier C are mixed is attracted toward the developing sleeve 41 by the magnetic force of the magnet 42 and a magnetic brush is produced thereby the developer is borne on the sleeve 41 and conveyed in the direction X.

The photosensitive drum 1 rotates in the direction Y while a magnetic brush of the developer is in contact with the photosensitive drum 1. As a result, the conveying force in the tangential direction of the developing sleeve 41 is weakened. Therefore, the developer is more difficult to pass through the closest portion A of the photosensitive drum 1 and the developing sleeve 41. Thus, the amount of developer conveyed to the closest portion A is less than that of the developer conveyed to the closest portion A thereby the developer is stagnated.

When the amount of stagnated developer increases and the developer accumulates to a position where the distance is far from the developing sleeve 41, the holding force to the developing sleeve side by a magnetic force of the magnet 42 becomes weak. Thus, the developer cannot be borne on the developing sleeve 41 and the developer is conveyed in the rotating direction Y of the photosensitive drum 1.

Figure 7A:
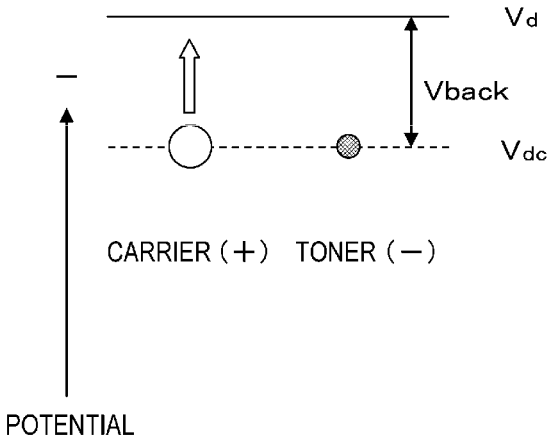
FIG. 7A is a diagram showing an electric field applied to a white background.
Figure 7B:
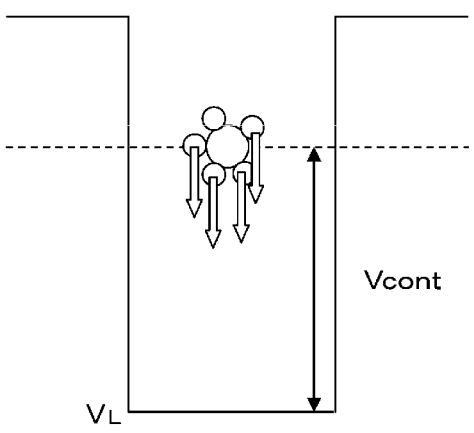
FIG. 7B is a diagram showing an electric field applied to the solid portion.

FIG. 7A is a diagram showing the electric field applied to the white background. FIG. 7B is a diagram showing the electric field applied to the solid portion. The image forming apparatus 100 of this embodiment is of a reversal development system and an electrostatic latent image formed by the exposure device 3 is developed with toner. Also, the developer is frictionally charged while the non-magnetic toner and the magnetic carrier are stirred in the developing device 4. The charged polarity of the non-magnetic toner is negative (−) and that of the magnetic carrier is positive (+).

As shown in FIG. 7A, in the white background, the photosensitive drum potential (Vd) and the developing sleeve potential (Vdc) are in a state of fog removal potential (Vback). In this embodiment, the drum potential Vd is set to −700V and the developing sleeve potential (Vdc) is set to −500V. Then, the negatively charged toner remains on the developing sleeve potential (Vdc). However, the positively charged carrier receives such a force as to move the carrier toward the photosensitive drum potential (Vd) which is more negative. Then, the force works in the direction F from the developing sleeve 41 toward the photosensitive drum 1 in addition to the rotation of the developing sleeve 41 and the force in the tangential direction E by the magnet 42. As a result, the conveying speed is reduced and stagnation of the developer is likely to occur at the closest portion A.

As shown in FIG. 7B, in the solid image portion, the photosensitive drum potential (Vd) is changed to the latent image potential (VL) by the exposure device 3 and the difference between the latent image potential (VL) and the developing sleeve potential (Vdc) becomes the contrast potential (Vcont). In this embodiment, although the latent image potential VL at a solid image is changed by the image density control, it is set roughly to about −140V to −300V. Then, the negatively charged toner receives such a force as to move the toner toward the latent image potential (VL) which is more positive and the positively charged carrier remains on the developing sleeve potential (Vdc).

However, in the case of a solid image, since the amount of toner to be supplied to the photosensitive drum 1 for development is large, a phenomenon called carrier adhesion during solid image occurs. In this phenomenon, the carrier as well as the toner electrostatically adhering to the surface of the carrier is used for development on the photosensitive drum. Then, similarly to the case of the white background, the force works in the direction F from the developing sleeve 41 toward the photosensitive drum 1 in addition to the rotation of the developing sleeve 41 and the force in the tangential direction E by the magnet 42. As a result, the conveying speed of the developer is reduced. Further, the carrier attracted toward the photosensitive drum 1 receives the force works in the direction G opposite to the direction E by the rotation of the photosensitive drum 1 thereby stagnation of the developer is likely to occur at the closest portion A.

Figure 8:
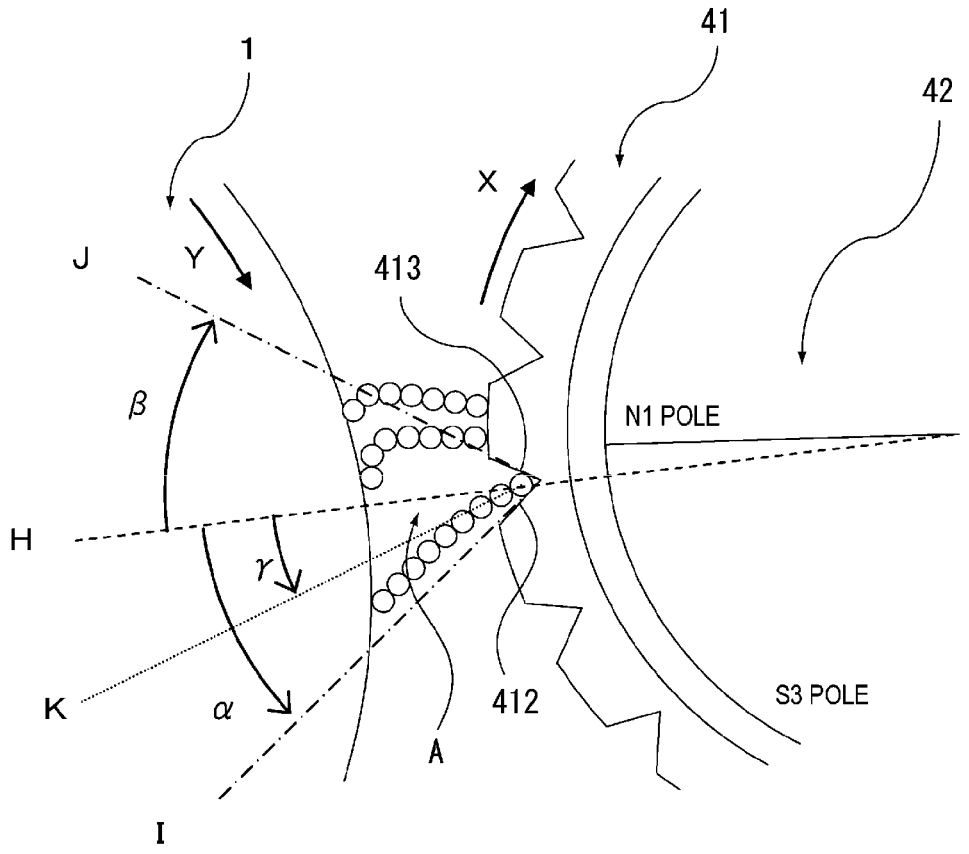
FIG. 8 is a schematic view of the vicinity of the developing portion of the image forming apparatus according to the first embodiment of the present invention.

(Linear grooves 411 formed on surface of developing sleeve 41) FIG. 8 is a schematic view of the vicinity of the developing portion of the image forming apparatus 100 according to this embodiment. In FIG. 8, the broken line H denotes a line connecting the rotational center of the photosensitive drum 1 and the rotational center of the developing sleeve 41. The dashed line I denotes a line obtained by extending the upstream wall 412 located in the upstream side of the rotational direction of the developing sleeve 41. The dashed line J denotes a line obtained by extending the downstream wall 413 located in the downstream side of the rotational direction of the developing sleeve 41. The solid line K denotes a line obtained by extending a part of a magnetic brush formed of the two-component developer near the surface of the developing sleeve 41. The angle formed by the broken line H and the dashed line I is set to $\alpha°$. The angle formed by the broken line H and the dashed line J is set to $\beta°$. The angle formed by the broken line H and the solid line K is set to $\gamma°$.

In a state where the photosensitive drum 1 is not disposed to face the developing sleeve 41, the magnetic brushes are formed along the direction of the magnetic field lines. Therefore, a magnetic brush stands in the direction perpendicular to the surface of the developing sleeve 41 in the vicinity of the magnetic poles of the magnet 42 (the peak positions in the normal directions of the magnetic flux density Br) and a magnetic brush tilts towards a magnetic pole between the magnetic poles. Then, the direction of the magnetic force line is represented by $\tan^{-1}(B\theta/Br)$ wherein Br denotes magnetic flux density in the normal direction of the magnet 42 and Bθ denotes magnetic flux density in the tangential direction of the magnet 42.

In the state where the photosensitive drum 1 is disposed to face the developing sleeve 41 and a magnetic brush is in contact with the photosensitive drum 1, a part of the magnetic brush at the vicinity of the tip of the magnetic brush is deformed and a part of the magnetic brush near the surface of the developing sleeve 41 is not deformed.

In this embodiment, the developing pole N1 of the magnet 42 is disposed at 6° in the downstream in the rotational direction X of the developing sleeve 41 from the closest portion A of the photosensitive drum 1 and the developing sleeve 41. Then, as shown in FIG. 8, the tip of a magnetic brush in the closest portion A tilts to the upstream side of the rotating direction X.

Table 1 shows the angles γ of magnetic brushes formed on the outermost surface of the developing sleeve 41 by the magnet pattern of the present embodiment. In Table 1, angle of developing pole N1 denotes an angle between a position located in the upstream side of the rotational direction of the developing sleeve and the developing pole N1. The angle γ denotes an angle between the magnetic brush and the direction perpendicular to the outermost surface (the surface of the non-groove portion) at the position.

TABLE 1

| Angle of developing pole N1 | 0° | 2° | 4° | 6° | 8° | 10° | 12° | 14° | 16° |
|---|---|---|---|---|---|---|---|---|---|
| Bθ (Gauss) | 0 | 100 | 200 | 290 | 375 | 460 | 550 | 620 | 675 |
| Br (Gauss) | 1050 | 1045 | 1020 | 1000 | 950 | 900 | 850 | 780 | 700 |
| $\tan^{-1}$ (Bθ/Br) | 0 | 0.09 | 0.19 | 0.28 | 0.38 | 0.47 | 0.57 | 0.67 | 0.77 |
| γ | 0° | | | 20° | | 30° | | | 45° |

In this embodiment, the developing pole N1 is provided at 6° in the downstream of the rotational direction X of the developing sleeve 41 from the closest portion A between the photosensitive drum 1 and the developing sleeve 41. Thus, the magnetic brush angle γ at the closest portion A is about 20°.

In this embodiment, the angle α between the direction perpendicular to the surface of the developing sleeve 41 and the upstream wall 412 is set to 40° which is larger than the magnetic brush angle γ at the closest portion A. In this embodiment, the depth of the linear grooves 411 is 100 μm and an average particle diameter of the magnetic carrier forming magnetic brush is 40 μm. Thus, the depth of the linear grooves 411 is greater than twice the average particle size of the carrier. Thus, approximately two carrier particles of a magnetic brush near the surface of the developing sleeve 41 fit one of the linear grooves 411.

As shown in FIG. 8, when the angle α of the upstream wall of the linear groove 411 is greater than the magnetic brush angle γ formed by two carrier particles, the magnetic brush is formed along the magnetic lines by the magnetic 42 not by the upstream wall 412. The carrier particles fitted to the linear groove 411 receive a conveying force from the upstream wall 412 by the rotation of the developing sleeve 41 thereby the magnetic brush is borne and conveyed.

In this embodiment, the angle β between the direction perpendicular to the surface of the developing sleeve 41 and the downstream wall 413 is set to 40° similarly to the angle α between the direction perpendicular to the surface of the developing sleeve 41 and the upstream wall 412. The angle β of the downstream wall 413 is defined regardless of the magnetic brush angle γ. That is, the angle β may be different from the angle α of the upstream wall 412 or may be the same as the angle α. When the sum of the angle α of the upstream wall 412 and the angle β of the downstream wall 413 is small, the carrier particles do not fit to the linear groove 411 and cannot be held. Therefore, the angles are set such that two or more carrier particles of a magnetic brush near the surface of the developing sleeve 41 fit into the linear groove 411.

Figure 9A:
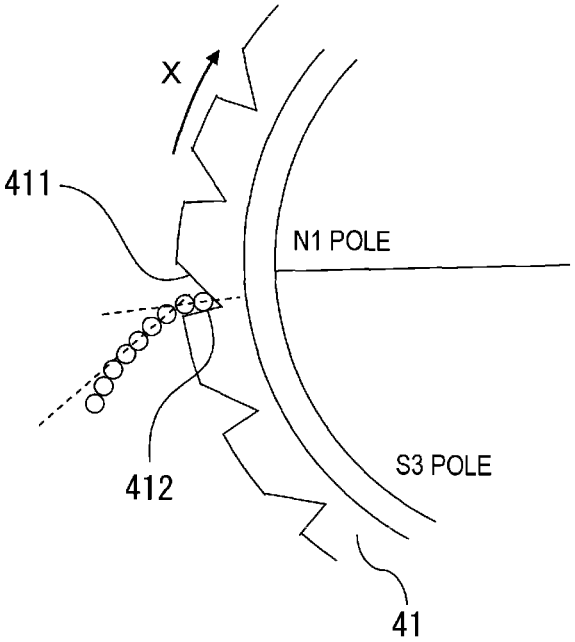
FIGS. 9A and 9B are schematic views of the vicinity of the developing portion of the image forming apparatus using a developing sleeve according to a comparative example.
Figure 9B:
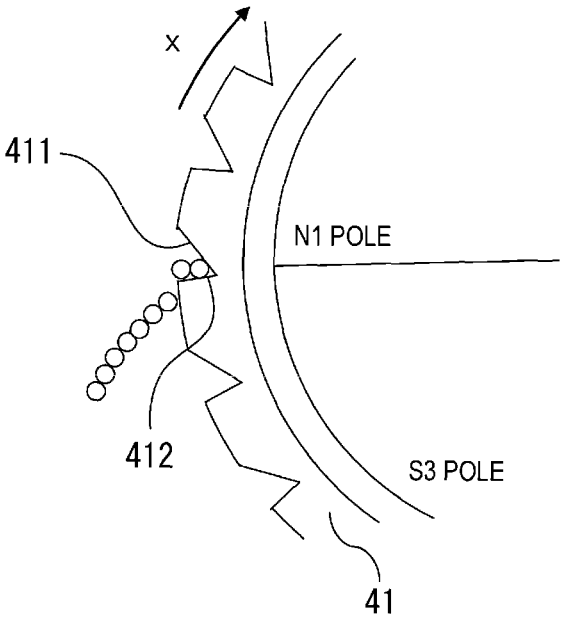

FIGS. 9A and 9B are schematic views of the vicinity of the developing portion of a comparative example when the angle α of the upstream wall 412 of the linear groove 411 is smaller than the magnetic brush angle γ formed by two carrier particles. As shown in FIG. 9A, when the angle α of the upstream wall 412 of the linear groove 411 is smaller than the angle γ formed by two carrier particles, carrier particles of one magnetic brush fitting into the linear groove 411 are formed along the angle α of the upstream wall 412. The carrier particles which do not fit into the linear groove 411 are formed into a magnetic brush along the magnetic field lines.

Therefore, the portion is generated where the magnetic brush angle changes and stress occurs at the portion thereby the magnetic brush becomes easy to break. When the developing sleeve 41 rotates in the X direction, the magnetic brush is broken as shown in FIG. 9B. The carrier particles to which the conveying force is no longer transmitted by the rotation of the developing sleeve 41 remain in the developing portion thereby the developer stagnation is likely to occur.

As shown in FIG. 8, by making the angle α of the upstream wall 412 larger than the magnetic brush angle γ at the closest portion A, a decrease in conveying performance is small even when a large amount of images is formed and stagnation of developer is suppressed while maintaining high developing performance. Also, by performing the roughening process in which linear groove shape is provided on the surface of the developing sleeve 41, a high resistance to wearing is obtained even when the large amount of images is formed.

Second Embodiment

Figure 10:
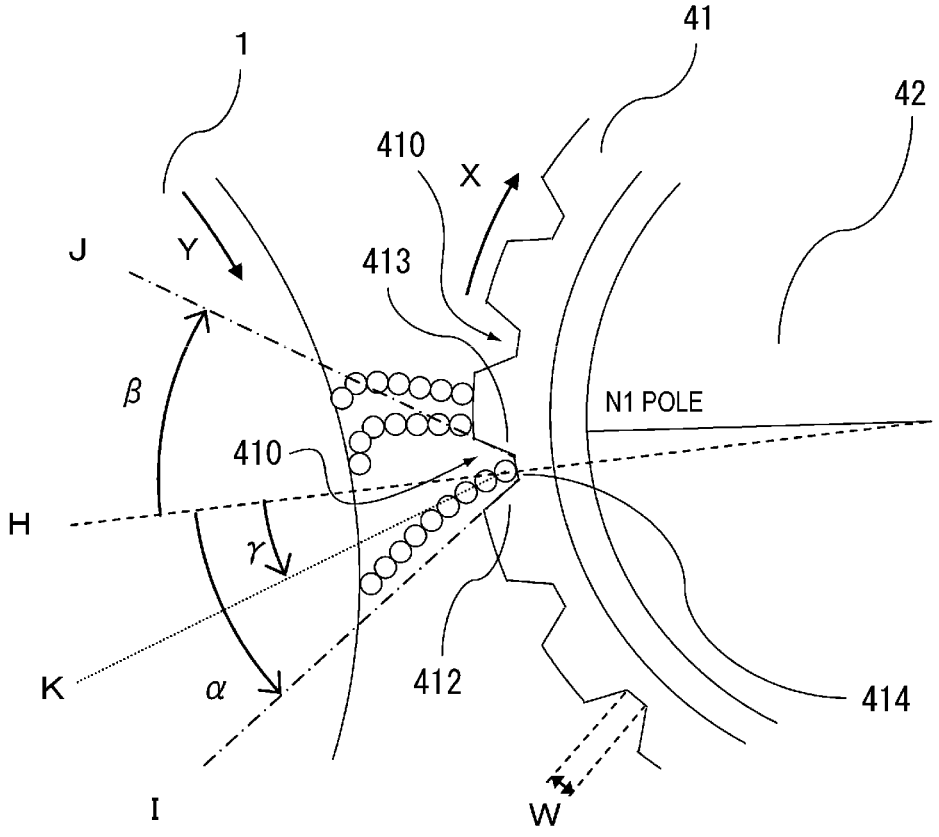
FIG. 10 is a schematic view of the vicinity of the developing portion of the image forming apparatus according to the second embodiment of the present invention.

Next, the second embodiment of an image forming apparatus according to the present invention will be described with reference to a figure. The description of the same parts as those of the first embodiment is omitted by assigning the same reference numerals thereto. FIG. 10 is a schematic view of the vicinity of the developing portion of the image forming apparatus 100 according to this embodiment.

As shown in FIG. 10, the image forming apparatus 100 of the present embodiment employs the linear groove 410 having a flat bottom shape in a cross-sectional view instead of employing the linear groove 411 having a V groove shape in a cross-sectional view. The linear groove 410 formed on the developing sleeve 41 is constituted of the upstream wall 412, the downstream wall 413 and the bottom surface 414. The linear groove 410 has a flat bottom in a cross-sectional view. In this embodiment, the magnetic brush angle γ is set to 20°, the angle α of the upstream wall 412 is set to 40°, the angle β of the downstream wall 413 is set to 40°, the width W of the bottom surface 414 is set to 60 μm and the depth of the linear groove 410 is set to 90 μm.

The developing sleeve 41 on the surface of which the linear groove 410 having such a cross section is formed is used in the developing device 4 of a counter developing system. In this case, as in the first embodiment, even when the large amount of image is formed, a decrease in conveying performance of developer is small and stagnation of developer is suppressed.

Third Embodiment

Figure 11:
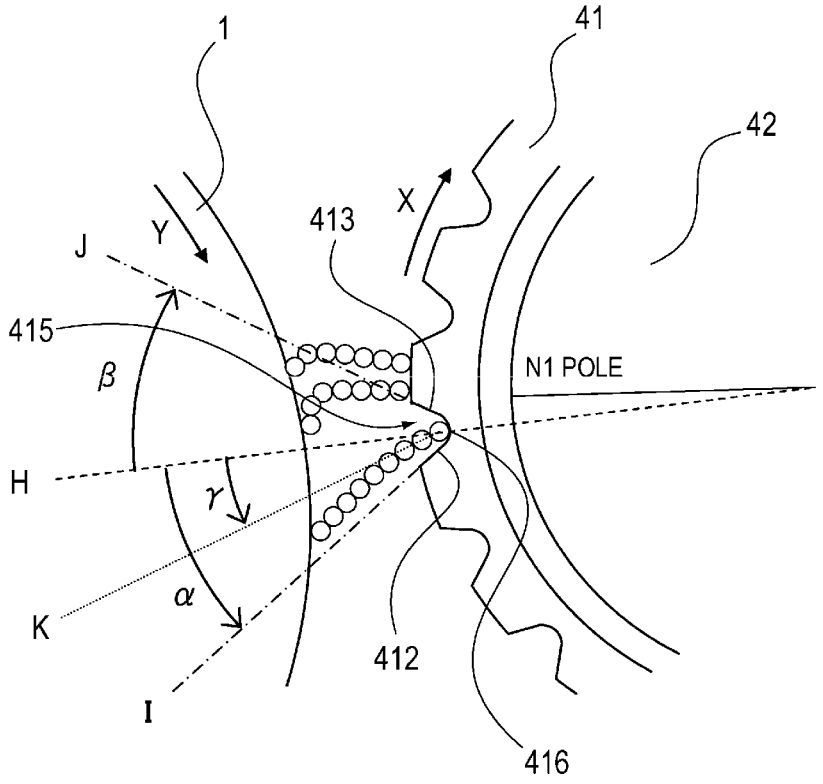
FIG. 11 is a schematic view of the vicinity of the developing portion of the image forming apparatus according to the third embodiment of the present invention.

Next, the third embodiment of an image forming apparatus according to the present invention will be described with reference to a figure. The description of the same parts as those of the first embodiment is omitted by assigning the same reference numerals thereto. FIG. 11 is a schematic view of the vicinity of the developing portion of the image forming apparatus 100 according to this embodiment.

As shown in FIG. 11, the image forming apparatus 100 of the present embodiment employs the linear groove 415 instead of the linear groove 411 having a V groove shape in a cross-sectional view. The cross-sectional view of the bottom surface 416 of the linear groove 415 has an arc shape. The linear groove 415 formed on the developing sleeve 41 is constituted of the upstream wall 412, the downstream wall 413 and the bottom surface 416. The linear groove 415 has an arc shaped bottom in a cross-sectional view. In this embodiment, the magnetic brush angle $\gamma$ is set to 20°, the angle $\alpha$ of the upstream wall 412 is set to 40°, the angle $\beta$ of the downstream wall 413 is set to 40° and the depth of the linear groove 415 is set to 90 μm.

The developing sleeve 41 on the surface of which the linear groove 415 having such a cross section is formed is used in the developing device 4 of a counter developing system. In this case, as in the first embodiment, even when the large amount of image is formed, a decrease in conveying performance of developer is small and stagnation of developer is suppressed.

As described above, according to the present invention of the image forming apparatus of the counter development method using a two-component developer, stagnation of developer at the vicinity of the opposing portion between the photosensitive drum and the developing sleeve is suppressed while maintaining high developing performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-124430, filed Jun. 17, 2014, which is hereby incorporated by reference herein in its entirety.

What is claimed is:

1. An image forming apparatus, comprising:

an image bearing member; and a developing device which develops an electrostatic latent image formed on the image bearing member into a toner image using toner, the developing device accommodating two-component developer in which toner and carrier are mixed, the developing device including a developer bearing member which has a developing sleeve and a magnet, the developing sleeve being rotatable in the direction opposite to the rotational direction of the image bearing member at a portion opposing to the image bearing member, the magnet being fixed and held in the developing sleeve, a plurality of grooves extending in the axial direction being provided on a surface of the developing sleeve at a predetermined interval in the circumferential direction, wherein an angle $\alpha$ between a wall surface of each of the grooves at an upstream side in the rotational direction of the developing sleeve and the direction perpendicular to the surface of the developing sleeve is greater than an angle $\gamma$ of a magnetic brush of the two-component developer formed at a closest portion between the image bearing member and the developer bearing member on an outermost surface of the developing sleeve.

2. The image forming apparatus according to claim 1, wherein the angle $\gamma=\tan^{-1}(B\theta/Br)$ where $B\theta$ denotes magnetic flux density in the tangential direction of the magnet formed at the closest portion on the developing sleeve and Br denotes magnetic flux density in the normal direction of the magnet formed at the closest portion on the developing sleeve.

3. The image forming apparatus according to claim 1, wherein the magnet includes a developing pole which is closest to the closest portion and a peak position of the developing pole located downstream in the rotation direction of the developing sleeve with respect to the closest portion.

4. The image forming apparatus according to claim 1, wherein a depth of the grooves is at least twice an average diameter of the carrier particles.

5. The image forming apparatus according to claim 1, wherein the grooves are of a V-shape in a cross-section.

6. The image forming apparatus according to claim 1, wherein the grooves are of a flat-bottom shape in a cross-section.

* * * * *